US008829807B1

(12) United States Patent
Yang et al.

(10) Patent No.: US 8,829,807 B1
(45) Date of Patent: Sep. 9, 2014

(54) BACKLIGHT DIMMING CIRCUIT, DIMMING METHOD OF THE SAME AND LIQUID CRYSTAL DISPLAY THEREOF

(71) Applicant: Shenzhen China Star Optoelectronics Technology Co., Ltd., Guangdong (CN)

(72) Inventors: Xiang Yang, Shenzhen (CN); Xinhong Chen, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 13/878,226

(22) PCT Filed: Mar. 5, 2013

(86) PCT No.: PCT/CN2013/072179

§ 371 (c)(1),
(2), (4) Date: Apr. 7, 2013

(51) Int. Cl.
*H05B 37/02* (2006.01)
*G09G 3/34* (2006.01)

(52) U.S. Cl.
CPC ..... *G09G 3/3406* (2013.01)
USPC ..... 315/291; 315/294; 315/307

(58) Field of Classification Search
None
See application file for complete search history.

(56) References Cited

U.S. PATENT DOCUMENTS 7,825,612 B2 * 11/2010 Lee ..... 315/308
8,159,151 B2 * 4/2012 Imanaka ..... 315/308
8,680,781 B1 * 3/2014 Pflaum ..... 315/291
2007/0210725 A1 * 9/2007 Marosek ..... 315/291
2010/0194310 A1 * 8/2010 Imanaka ..... 315/307
2010/0308738 A1 * 12/2010 Shteynberg et al. ..... 315/185 R
2011/0043134 A1 * 2/2011 Lee ..... 315/294
2012/0081009 A1 * 4/2012 Shteynberg et al. ..... 315/122

* cited by examiner

*Primary Examiner* — Crystal L Hammond
(74) *Attorney, Agent, or Firm* — Andrew C. Cheng

(57) ABSTRACT

The present invention provides a backlight dimming circuit, a dimming method of the same and a liquid crystal display thereof. The backlight dimming circuit comprises a power supply voltage terminal VCC, which is used to provide supply voltage; an operational amplifier Q, the noninverting input terminal of which connected with the power supply voltage terminal VCC, and the inverting input terminal of which connected with a load terminal; a precision resistor R, which is connected between the noninverting input terminal and the inverting input terminal of the operational amplifier Q, the voltage differential signal across the precision resistor R being converted and amplified to a DC voltage signal by the operational amplifier Q and outputting; and a comparator C, the noninverting input terminal of which receiving the DC voltage signal output from the operational amplifier Q, and the inverting input terminal of which receiving a sawtooth signal from a boost IC in a boost converter, which is used to compare the DC voltage signal with the sawtooth signal of the boost IC and then outputting a pulse width modulation dimming signal according the comparison results. The structure of the present invention is simple, and the costs are low. The backlight brightness is associated with the screen in real-time, which reduces the backlight power consumption and promotes the energy conservation of the products.

10 Claims, 1 Drawing Sheet

BACKLIGHT DIMMING CIRCUIT, DIMMING METHOD OF THE SAME AND LIQUID CRYSTAL DISPLAY THEREOF

This application claims priority to Chinese Patent Application Serial No. 201310059850.4, named as "Backlight dimming circuit, dimming method of the same and liquid crystal display thereof", filed on Feb. 26, 2013, the specification of which is incorporated herein by reference.

BACKGROUND OF THE INVENTION

1. Field of the Invention

The present invention relates to the field of image display, and in particular to a backlight dimming circuit, a dimming method of the same and a liquid crystal display thereof.

2. The Related Arts

Nowadays, the main theme of the industry is green energy saving and environmental protection, especially large-size liquid crystal display needs to save energy. Take 48 inch as example, total power is 120W, wherein the backlight power is approximately 60W, which accounts for 50% of total power. Therefore, in the green energy conservation of the products, the energy conservation of the backlight will play an important role. There are multiple techniques to adjust the brightness of the backlight to save energy through a variety of ways.

The first is manual dimming, that is, the user manually adjusts through an operation menu. This method is not smart, and manual adjustment leads to complicated operation. Furthermore, manual adjustment is not real-time because the brightness of the screen changes constantly.

The second is the ambient light sense dimming, that is, sense the ambient light levels by the ambient light sensor, such as photodiode or transistor, convert the brightness perceived by the ambient light sensor into current or voltage, and automatically adjust the brightness of the display backlight by a processor based on a preset threshold. When the brightness of the ambient light is high, the backlight of LCD is automatically adjusted to high-brightness; when the external environment is darker, the backlight of LCD is automatically adjusted to low-brightness to reduce the power consumption of the backlight. However, this method needs the perception of the light sensor on the brightness of the ambient light, which is not real-time and slow response. It also requires MCU hardware to support, so the costs are higher.

The third is local dimming, that is, divide the entire screen into several matrix regions, MCU proceeds with analysis and calculation according to the screen brightness of each region, and then independently control the brightness of the backlight of each region. This method also requires MCU hardware to support, the use of LED driver becomes more as more regions, and the algorithm and the timing control become more complex, which greatly increase the entire costs.

In summary, provide a backlight dimming method with low-cost and real-time is a goal of the industry's ongoing efforts.

SUMMARY OF THE INVENTION

The technical issue to be solved by the present invention is to provide a backlight dimming circuit, a dimming method of the same and a liquid crystal display thereof with low-cost and real-time.

In order to solve the technical issue, the present invention provides a backlight dimming circuit, comprising a power supply voltage terminal VCC, which is used to provide supply voltage; an operational amplifier Q, the noninverting input terminal of which connected with the power supply voltage terminal VCC, and the inverting input terminal of which connected with a load terminal; a precision resistor R, which is connected between the noninverting input terminal and the inverting input terminal of the operational amplifier Q, the voltage differential signal across the precision resistor R being converted and amplified to a DC voltage signal by the operational amplifier Q and outputting; and a comparator C, the noninverting input terminal of which receiving the DC voltage signal output from the operational amplifier Q, and the inverting input terminal of which receiving a sawtooth signal from a boost IC in a boost converter, which is used to compare the DC voltage signal with the sawtooth signal of the boost IC and then outputting a pulse width modulation dimming signal according the comparison results.

Wherein, the DC voltage signal is the input voltage VIN+ of the noninverting input terminal of the comparator C, and the sawtooth signal of the boost IC is the input voltage VIN− of the inverting input terminal of the comparator C.

Wherein, the comparator C outputs the pulse width modulation dimming signal with larger duty cycle when the VIN+ is larger than the VIN−, used to increase the brightness of the backlight; the comparator C outputs the pulse width modulation dimming signal with smaller duty cycle when the VIN+ is smaller than the VIN−, used to decrease the brightness of the backlight.

Wherein, the resistance of the precision resistor R is less than or equal to 0.1 ohm.

The present invention further provides a dimming method of backlight dimming circuit, the backlight dimming circuit comprising: a power supply voltage terminal VCC; a operational amplifier Q, the noninverting input terminal of which connected with the power supply voltage terminal VCC, and the inverting input terminal of which connected with a load terminal; a precision resistor R, which is connected between the noninverting input terminal and the inverting input terminal of the operational amplifier Q; and a comparator C, the noninverting input terminal of which receiving the DC voltage signal output from the operational amplifier Q, and the inverting input terminal of which receiving a sawtooth signal from a boost IC in a boost converter; the dimming method comprising the steps of: converting and amplifying the voltage differential signal across the precision resistor R to a DC voltage signal by the operational amplifier Q and outputting to the comparator C; comparing the DC voltage signal with the sawtooth signal of the boost IC by the comparator C and then outputting a pulse width modulation dimming signal according the comparison results; and adjusting the brightness of the backlight according to the pulse width modulation dimming signal output from the comparator.

Wherein, the comparator C outputs the pulse width modulation dimming signal with larger duty cycle when the DC voltage signal is larger than the sawtooth signal of the boost IC, and further increase the brightness of the backlight; the comparator C outputs the pulse width modulation dimming signal with smaller duty cycle when the DC voltage signal is smaller than the sawtooth signal of the boost IC, and further decrease the brightness of the backlight.

The present invention further provides a liquid crystal display, comprising a backlight dimming circuit, the backlight dimming circuit further comprising: a power supply voltage terminal VCC, which is used to provide supply voltage; an operational amplifier Q, the noninverting input terminal of which connected with the power supply voltage terminal VCC, and the inverting input terminal of which connected with a load terminal; a precision resistor R, which is connected between the noninverting input terminal and the inverting input terminal of the operational amplifier Q, the voltage differential signal across the precision resistor R being converted and amplified to a DC voltage signal by the operational amplifier Q and outputting; and a comparator C, the noninverting input terminal of which receiving the DC voltage signal output from the operational amplifier Q, and the inverting input terminal of which receiving a sawtooth signal from a boost IC in a boost converter, which is used to compare the DC voltage signal with the sawtooth signal of the boost IC and then outputting a pulse width modulation dimming signal according the comparison results.

Wherein, the DC voltage signal is the input voltage VIN+ of the noninverting input terminal of the comparator C, and the sawtooth signal of the boost IC is the input voltage VIN− of the inverting input terminal of the comparator C.

Wherein, the comparator C outputs the pulse width modulation dimming signal with larger duty cycle when the VIN+ is larger than the VIN−, used to increase the brightness of the backlight; the comparator C outputs the pulse width modulation dimming signal with smaller duty cycle when the VIN+ is smaller than the VIN−, used to decrease the brightness of the backlight.

Wherein, the resistance of the precision resistor R is less than or equal to 0.1 ohm.

The backlight dimming circuit, the dimming method of the same and the liquid crystal display thereof have simple structure, which does not affect the original circuit architecture and the program, so that the costs are low. The backlight brightness is associated with the screen in real-time, which reduces the data conversion and the data transmission in the other existing programs and detects in real-time. The backlight responds in real-time, which reduces the backlight power consumption and promotes the energy conservation of the products.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort.

DETAILED DESCRIPTION OF THE PREFERRED EMBODIMENTS

The detailed descriptions according to the preferred embodiment of the present invention are as follows.

To achieve low-cost and real-time backlight dimming, the embodiment of the present invention is mainly based on two aspects. First, consider that the display of the liquid crystal panel is charging—storage process, the screen brightness is proportional to the current. The higher the brightness of the screen is, the greater voltage difference is required, the greater the current overall Balloting contained, and the entire sourcing current is larger. Accordingly, take the amount of the sourcing current as a measurement object, and it can determine the bright and dark of the screen in real time according to the amount of the current. Furthermore, the brightness changes of the real-time screen can be obtained according to the amount of the current. On the other hand, after obtaining the real-time screen brightness, it needs to associate with the pulse width modulation (PWM) dimming signal and then control the brightness of the backlight by the dimming signal. Of course, the concrete realization needs low-cost inputs, so that directly increase the circuit on the original circuit and do not affect the original circuit architecture and the program.

Figure 1:
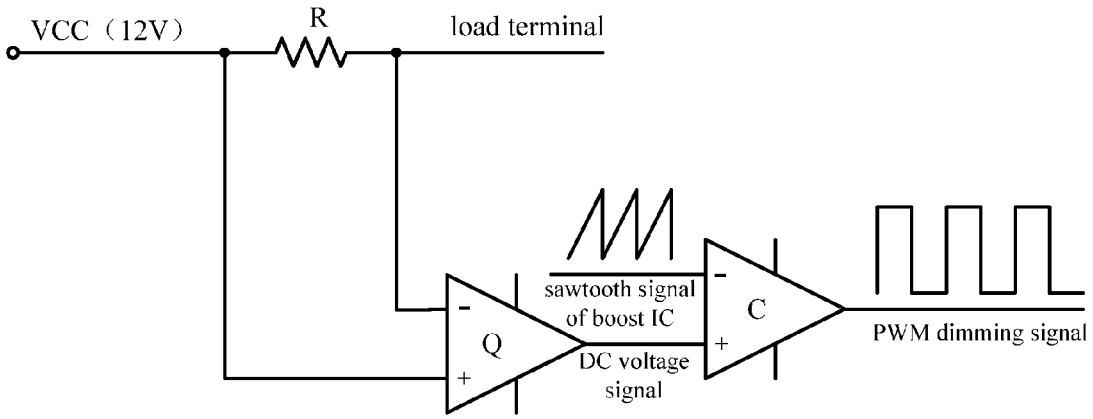
FIG. 1 is a schematic view illustrating the structure of a backlight dimming circuit according to the embodiment of the present invention.

Referring to FIG. 1, a backlight dimming circuit according to the embodiment of the present invention uses the existing DC conversion circuit and inserts a precision resistor R. When the screen changes, the current flowing through the precision resistor R will change accordingly. Detect the changes of the current by the precision resistor R, and the brightness changes of the screen can be informed, thus dim pertinently.

Specifically, the backlight dimming circuit according to the embodiment of the present invention comprises:

a power supply voltage terminal VCC, which is used to provide supply voltage; an operational amplifier Q, the noninverting input terminal of which connected with the power supply voltage terminal VCC, and the inverting input terminal of which connected with a load terminal;

a precision resistor R, which is connected between the noninverting input terminal and the inverting input terminal of the operational amplifier Q, the voltage differential signal across the precision resistor R being converted and amplified to a DC voltage signal by the operational amplifier Q and outputting;

a comparator C, the noninverting input terminal of which receiving the DC voltage signal output from the operational amplifier Q, and the inverting input terminal of which receiving a sawtooth signal from a boost IC in a boost converter, which is used to compare the DC voltage signal with the sawtooth signal of the boost IC and then outputting a PWM dimming signal according the comparison results.

It is noted that the inserted precision resistor R will cause the loss. In order to minimize the loss, the resistance of the precision resistor R in the present embodiment is less than or equal to 0.1 ohm.

The working principle of the backlight dimming circuit according the present embodiment is as follows. As mentioned above, the brightness of the screen is proportional to the sourcing current (the current flowing through the precision resistor R) from the power supply voltage terminal VCC of the PWM IC. Wherein, it is low loading in black pattern and high loading in white pattern. The above proportional relationship can be simply expressed as a formula: $I=Imin+gray/255\times(Imax-Imin)$. Wherein, Imin represents the current while low loading, gray represents the grayscale of the current screen, and Imax represents the current while high loading. Assuming the display is screen P1, the current flowing the precision resistor R is I1, and the voltage difference is V1. After converting by the operational amplifier Q, output the DC voltage signal VDC1. The DC voltage signal VDC1 is taken as the input voltage VIN+ of the noninverting input terminal of the comparator C, and the sawtooth signal of the boost IC is taken as the input voltage VIN− of the inverting input terminal of the comparator C. The comparator C outputs the high level PWM dimming signal with larger duty cycle when the VIN+ is larger than the VIN−, used to increase the brightness of the backlight; otherwise, the comparator C outputs the low level PWM dimming signal with smaller duty cycle when the VIN+ is smaller than the VIN−, used to decrease the brightness of the backlight. By this way, the brightness of the current screen is associated with the PWM dimming signal in real-time, which achieves the real-time dimming, and dimming delay won't happen. For example, if the screen P1 is dark, the current I1 flowing through the precision resistor R is smaller, and the DC voltage signal VDC1 (VIN+) converted by the operational amplifier Q is also smaller, which is smaller than the sawtooth signal of the boost IC (VIN−) when comparing in the comparator C. Therefore, output the low level PWM dimming signal with smaller duty cycle to lower the backlight brightness and save the power consumption.

Similarly, when the display is screen P2, it is also output the associated PWM dimming signal in real time by the same principle. If the screen P1 and P2 are adjacent, it will involve in the brightness changes of the screen. For example, when screen P1 is dark and screen P2 is bright, that is, when the current screen changes from dark to bright, the current flowing through the precision resistor R is increased, and the voltage difference is increased accordingly. The DC voltage signal VDC1 (VIN+) converted by the operational amplifier Q is also increased, which is larger than the sawtooth signal of the boost IC (VIN−). Therefore, the comparator C outputs the high level PWM dimming signal to increase the backlight brightness. Take another example, when screen P1 is bright and screen P2 is dark, that is, when the current screen changes from bright to dark, the current flowing through the precision resistor R is decreased, and the voltage difference is decreased accordingly. The DC voltage signal VDC1 (VIN+) converted by the operational amplifier Q is also decreased, which is smaller than the sawtooth signal of the boost IC (VIN−). Therefore, the comparator C outputs the low level PWM dimming signal to decrease the backlight brightness.

Figure 2:
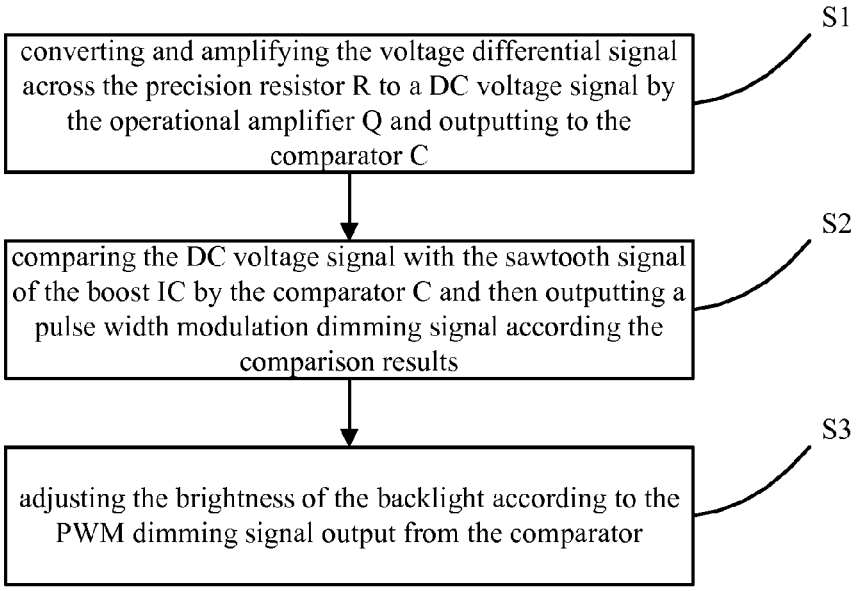
FIG. 2 is a schematic view illustrating the flow diagram of a dimming method of backlight dimming circuit according to the embodiment of the present invention.

As mentioned above, the second embodiment of the present invention provides a dimming method of backlight dimming circuit, the backlight dimming circuit comprising: a power supply voltage terminal VCC; a operational amplifier Q, the noninverting input terminal of which connected with the power supply voltage terminal VCC, and the inverting input terminal of which connected with a load terminal; a precision resistor R, which is connected between the noninverting input terminal and the inverting input terminal of the operational amplifier Q; and a comparator C, the noninverting input terminal of which receiving the DC voltage signal output from the operational amplifier Q, and the inverting input terminal of which receiving a sawtooth signal from a boost IC in a boost converter; referring to FIG. 2, the dimming method comprising the steps of:

S1, converting and amplifying the voltage differential signal across the precision resistor R to a DC voltage signal by the operational amplifier Q and outputting to the comparator C;

S2, comparing the DC voltage signal with the sawtooth signal of the boost IC by the comparator C and then outputting a pulse width modulation dimming signal according the comparison results; and S3, adjusting the brightness of the backlight according to the PWM dimming signal output from the comparator.

Specifically, the comparator C outputs the high level PWM dimming signal with larger duty cycle when the DC voltage signal is larger than the sawtooth signal of the boost IC, and further increase the brightness of the backlight; otherwise, the comparator C outputs the low level PWM dimming signal with smaller duty cycle when the DC voltage signal is smaller than the sawtooth signal of the boost IC, and further decrease the brightness of the backlight.

The third embodiment of the present invention provides a liquid crystal display, comprising a backlight dimming circuit according to the first embodiment. In order to describe simply, the working principle of the backlight dimming circuit will not be repeated here.

The backlight dimming circuit, the dimming method of the same and the liquid crystal display thereof according to the present invention have simple structure, which does not affect the original circuit architecture and the program, so that the costs are low. The backlight brightness is associated with the screen in real-time, which reduces the data conversion and the data transmission in the other existing programs and detects in real-time. The backlight responds in real-time, which reduces the backlight power consumption and promotes the energy conservation of the products.

The disclosed embodiments are the preferred embodiments of the present invention, but not intending to impose any unduly constraint to the appended claims. Any equivalent change is considered encompassed in the scope of protection defined by the clams of the present invention.

What is claimed is:

1. A backlight dimming circuit, comprising:

a power supply voltage terminal VCC, which is used to provide supply voltage;

an operational amplifier Q, the noninverting input terminal of which connected with the power supply voltage terminal VCC, and the inverting input terminal of which connected with a load terminal;

a precision resistor R, which is connected between the noninverting input terminal and the inverting input terminal of the operational amplifier Q, the voltage differential signal across the precision resistor R being converted and amplified to a DC voltage signal by the operational amplifier Q and outputting; and a comparator C, the noninverting input terminal of which receiving the DC voltage signal output from the operational amplifier Q, and the inverting input terminal of which receiving a sawtooth signal from a boost IC in a boost converter, which is used to compare the DC voltage signal with the sawtooth signal of the boost IC and then outputting a pulse width modulation dimming signal according the comparison results.

2. The backlight dimming circuit as claimed in claim 1, wherein the DC voltage signal is the input voltage VIN+ of the noninverting input terminal of the comparator C, and the sawtooth signal of the boost IC is the input voltage VIN− of the inverting input terminal of the comparator C.

3. The backlight dimming circuit as claimed in claim 2, wherein the comparator C outputs the pulse width modulation dimming signal with larger duty cycle when the VIN+ is larger than the VIN−, used to increase the brightness of the backlight; the comparator C outputs the pulse width modulation dimming signal with smaller duty cycle when the VIN+ is smaller than the VIN−, used to decrease the brightness of the backlight.

4. The backlight dimming circuit as claimed in claim 1, wherein the resistance of the precision resistor R is less than or equal to 0.1 ohm.

5. A dimming method of backlight dimming circuit, the backlight dimming circuit comprising: a power supply voltage terminal VCC; a operational amplifier Q, the noninverting input terminal of which connected with the power supply voltage terminal VCC, and the inverting input terminal of which connected with a load terminal; a precision resistor R, which is connected between the noninverting input terminal and the inverting input terminal of the operational amplifier Q; and a comparator C, the noninverting input terminal of which receiving the DC voltage signal output from the operational amplifier Q, and the inverting input terminal of which receiving a sawtooth signal from a boost IC in a boost converter; the dimming method comprising the steps of:

converting and amplifying the voltage differential signal across the precision resistor R to a DC voltage signal by the operational amplifier Q and outputting to the comparator C;

comparing the DC voltage signal with the sawtooth signal of the boost IC by the comparator C and then outputting a pulse width modulation dimming signal according the comparison results; and adjusting the brightness of the backlight according to the pulse width modulation dimming signal output from the comparator.

6. The dimming method of backlight as claimed in claim 5, wherein the comparator C outputs the pulse width modulation dimming signal with larger duty cycle when the DC voltage signal is larger than the sawtooth signal of the boost IC, and further increase the brightness of the backlight; the comparator C outputs the pulse width modulation dimming signal with smaller duty cycle when the DC voltage signal is smaller than the sawtooth signal of the boost IC, and further decrease the brightness of the backlight.

7. A liquid crystal display, comprising a backlight dimming circuit, the backlight dimming circuit further comprising:

a power supply voltage terminal VCC, which is used to provide supply voltage;

an operational amplifier Q, the noninverting input terminal of which connected with the power supply voltage terminal VCC, and the inverting input terminal of which connected with a load terminal;

a precision resistor R, which is connected between the noninverting input terminal and the inverting input terminal of the operational amplifier Q, the voltage differential signal across the precision resistor R being converted and amplified to a DC voltage signal by the operational amplifier Q and outputting; and a comparator C, the noninverting input terminal of which receiving the DC voltage signal output from the operational amplifier Q, and the inverting input terminal of which receiving a sawtooth signal from a boost IC in a boost converter, which is used to compare the DC voltage signal with the sawtooth signal of the boost IC and then outputting a pulse width modulation dimming signal according the comparison results.

8. The liquid crystal display as claimed in claim 7, wherein the DC voltage signal is the input voltage VIN+ of the noninverting input terminal of the comparator C, and the sawtooth signal of the boost IC is the input voltage VIN− of the inverting input terminal of the comparator C.

9. The liquid crystal display as claimed in claim 8, wherein the comparator C outputs the pulse width modulation dimming signal with larger duty cycle when the VIN+ is larger than the VIN−, used to increase the brightness of the backlight; the comparator C outputs the pulse width modulation dimming signal with smaller duty cycle when the VIN+ is smaller than the VIN−, used to decrease the brightness of the backlight.

10. The liquid crystal display as claimed in claim 7, wherein the resistance of the precision resistor R is less than or equal to 0.1 ohm.

* * * * *